US007007335B1

(12) United States Patent
Doat

(10) Patent No.: US 7,007,335 B1
(45) Date of Patent: Mar. 7, 2006

(54) TOOTHBRUSH SPONTANEOUSLY TAKING UP STABLE EQUILIBRIUM POSITION ON A HORIZONTAL SUPPORT

(75) Inventor: Arnaud Doat, Castres (FR)

(73) Assignee: Pierre Fabre Sante, Boulogne Billancourt (FR)

( * ) Notice: Subject to any disclaimer, the term of this patent is extended or adjusted under 35 U.S.C. 154(b) by 0 days.

(21) Appl. No.: 09/913,350

(22) PCT Filed: Feb. 16, 2000

(86) PCT No.: PCT/FR00/00384

§ 371 (c)(1),
(2), (4) Date: Aug. 13, 2001

(87) PCT Pub. No.: WO00/48483

PCT Pub. Date: Aug. 24, 2000

(30) Foreign Application Priority Data

Feb. 18, 1999 (FR) ..... 99 01988

(51) Int. Cl.
*A46B 5/00* (2006.01)
*A46B 9/04* (2006.01)

(52) U.S. Cl. ..... 15/167.1; 15/143.1; 248/910

(58) Field of Classification Search ..... 15/167.1, 15/143.1; 248/364, 910
See application file for complete search history.

(56) References Cited

U.S. PATENT DOCUMENTS

| | | | | |
|---|---|---|---|---|
| 442,510 | A | * | 12/1890 | Burton |
| 860,527 | A | * | 7/1907 | Cochrane |
| 1,048,778 | A | * | 12/1912 | Wood |
| 1,593,763 | A | * | 7/1926 | Henderson |
| D123,388 | S | * | 11/1940 | Duey |
| 2,414,775 | A | * | 1/1947 | Stavely |
| D165,248 | S | * | 11/1951 | Sherrod |
| 2,722,703 | A | * | 11/1955 | Green |
| 3,968,950 | A | * | 7/1976 | Gallo |
| 5,353,464 | A | * | 10/1994 | Atkins |
| 5,860,190 | A | * | 1/1999 | Cano |
| 5,956,796 | A | * | 9/1999 | Lodato |
| 6,134,790 | A | * | 10/2000 | Watson |
| 6,141,815 | A | * | 11/2000 | Harrison |

FOREIGN PATENT DOCUMENTS

| | | | |
|---|---|---|---|
| CH | 180027 | * | 12/1935 |
| EP | 06090823 | * | 4/1994 |
| EP | 0841025 | | 5/1998 |
| FR | 2654314 | | 5/1991 |
| FR | 2751856 | | 2/1998 |
| WO | WO84/01700 | | 5/1984 |
| WO | WO 8401700 | | 5/1984 |
| WO | WO 91/07114 | * | 5/1991 |

* cited by examiner

*Primary Examiner*—Randall Chin
(74) *Attorney, Agent, or Firm*—Hueschen and Sage

(57) ABSTRACT

The invention concerns a toothbrush (2), elongated in shape, comprising bristles (9), and arranged to have on a horizontal flat support (30) at least a stable equilibrium position wherein the longitudinal direction of the toothbrush is substantially parallel to the support and the bristles (9) extending at some distance from the support and towards the support. Said position(s) of stable equilibrium is/are the only position(s) of stable equilibrium of the toothbrush on the support.

14 Claims, 2 Drawing Sheets

TOOTHBRUSH SPONTANEOUSLY TAKING UP STABLE EQUILIBRIUM POSITION ON A HORIZONTAL SUPPORT

The invention relates to toothbrushes.

A toothbrush with a handle of elongate form and a head containing bristles is known. The shape of the handle of the brush is profiled to a triangular cross section. When placed on a flat horizontal support, it therefore has three positions of stable equilibrium. In two of these positions, the bristles point up away from the support. In the third position the bristles extend toward the flat support while being at a distance from it. The toothbrush can be left in this position after use. It can therefore drain and dry without the bristles being in contact with the support. Furthermore, as this position corresponds to a stable equilibrium, the user has only to deposit the brush in a position near the stable position for the brush spontaneously to revert to this stable position. The handling of the brush therefore requires no particular care by the user. Nonetheless, in the other two positions, the bristles are oriented upward and are therefore likely to come into contact with other objects which the user may be handling. This is detrimental to good brush hygiene.

It is an object of the invention to provide a brush that is simpler to handle and further reduces the risk of contact between the bristles and an external item.

In order to achieve this object, the invention provides a toothbrush of elongate form, comprising bristles, and so designed as to exhibit, on a flat horizontal support, at least one position of stable equilibrium in which the longitudinal direction of the brush is essentially parallel to the support and the bristles lie at a distance from the support and extend toward the support, in which brush said position(s) of stable equilibrium is or are the only position(s) of stable equilibrium of the brush on the support.

Thus, in whatever position the user deposits the brush on the support, the brush will adopt the position in which the bristles point toward the support and are at a distance from it and therefore have little exposure to contact with another item. Given that the user can deposit the brush in any position on the support to achieve this result, the care required to handle this toothbrush is much reduced even though the brush ensures good bristle hygiene.

The expression "position of stable equilibrium" here means a position to which the brush reverts spontaneously under the action of gravity once the brush has been deposited in any position near to the stable position, sometimes after a few oscillations about the stable position. (Of course, if there is only one stable position, this function will apply whatever the initial position.) From a physical point of view, in the or each position of stable equilibrium, the potential energy of the brush associated with the gravity of the Earth is at an absolute or local minimum compared with the other, unstable positions. Hence the expression "potential trough".

The or each stable position depends on the volume of the brush and on the distribution of its mass.

Advantageously, there is only one said position of stable equilibrium of the brush.

Thus, this position may be that in which the bristles are as close as possible to the support, without being in contact with it, and are at the least risk of being contacted by another object.

Advantageously, the brush comprises:

a distal portion;

a proximal portion extending between the bristles and the distal portion in the longitudinal direction; and an intermediate portion between the distal and proximal portions, the brush being so designed that, for any position in which the brush is supported by a flat horizontal support with the longitudinal direction essentially parallel to the support, the distal and proximal portions constitute the portions of contact of the brush with the flat support and the intermediate portion lies at a distance from the support.

Thus, the proximal portion ensures that the brush rolls on the support from any initial position to the or each stable position.

Advantageously, the brush is so designed that the proximal portion exhibits a single point of contact with the support in the or each position of stable equilibrium.

Advantageously, the brush is so designed that, for any position in which the brush is supported by a flat horizontal support with the longitudinal direction essentially parallel to the support, the proximal portion exhibits a single point of contact with the support.

Advantageously, the proximal portion is of a generally flat shape.

Thus the proximal portion can act as a contact surface for one or more fingers of the hand of the user manipulating the brush as a means of holding the brush more securely in the hand, or turning it more easily in the hand during brushing. This contact surface can be used in particular by the thumb or index finger of this hand. Moreover, the proximal portion forms an obstacle that will tend to limit or even prevent fluid running from the bristles down the handle to the user's hand. The handle thus remains clean and dry during brushing.

Advantageously, the proximal portion is of a generally flat shape in a plane essentially perpendicular to the longitudinal direction of the brush.

Advantageously, the proximal portion is of a generally flat shape in a plane that is essentially inclined with respect to the longitudinal direction of the brush.

Advantageously, the proximal portion is off-center with respect to a central longitudinal axis of the brush.

Thus, the proximal portion makes a significant, even determining, contribution to rocking the brush into the or each stable position.

Advantageously, the brush comprising a handle, the proximal portion projects from a side of the handle opposite another side of the handle supporting the bristles.

Advantageously, the proximal portion projects from the handle all the way around a longitudinal axis of the brush.

Advantageously, the proximal portion forms with the handle a re-entrant edge on a side of the proximal portion situated toward the bristles.

Thus, the proximal portion forms a highly effective obstacle to fluid running from the bristles toward the handle.

Advantageously, the proximal portion forms with the handle a re-entrant edge on a side of the proximal portion situated toward the distal portion.

Thus, the proximal portion forms a good abutment to the fingers of the hand holding the brush.

Advantageously, the proximal portion has an elastomeric outer face.

Thus, the rocking of the brush into the or a stable position occurs silently, even if the flat support is made of a hard material. This ensures that there is no disagreeable noise, even if the brush oscillates for a few moments about the stable position.

Advantageously, the brush is so designed that the distal portion exhibits two points of contact with the support in the or each position of stable equilibrium.

Advantageously, the distal portion has a flat generally parallel to the longitudinal direction of the brush.

Advantageously, the brush has the shape illustrated in one of FIGS. 1–5.

The invention also provides a toothbrush of elongate form and comprising bristles, so designed that, when the brush is placed in any initial position on a flat horizontal support, the brush spontaneously adopts a stable position in which the longitudinal direction of the brush is essentially parallel to the support and the bristles lie at a distance from the support and extend toward the support.

Advantageously, the brush is so designed that the stable position is always the same, whatever said initial position may be.

Other features and advantages of the invention will become clearer in the course of the following description of four preferred embodiments given by way of nonlimiting examples. In the accompanying drawings.

Figure 1:
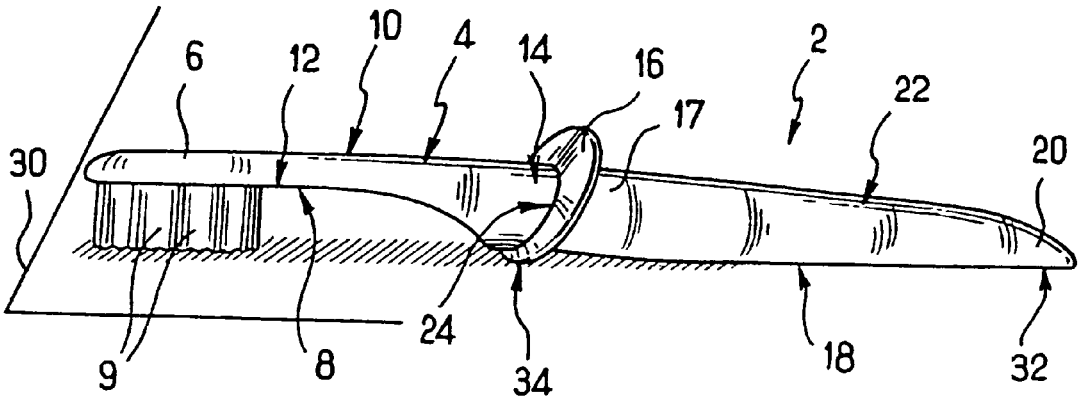
FIG. 1 is a perspective view of a toothbrush in a first embodiment of the invention, resting on a support.
Figure 2:
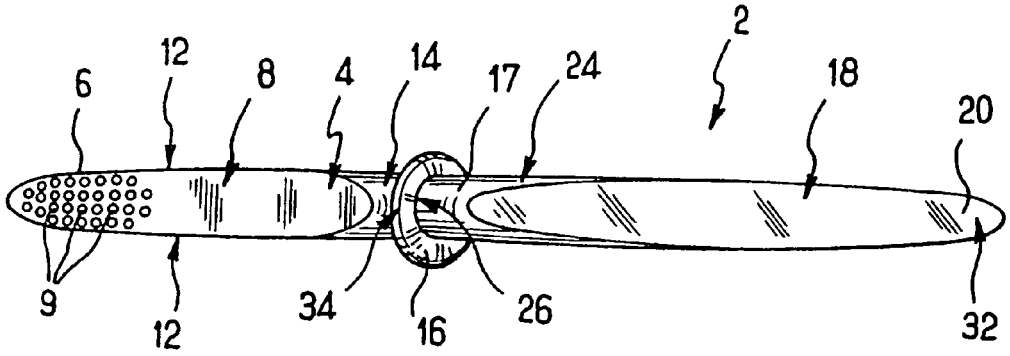
FIG. 2 is a view of the underside of the brush shown in FIG. 1.

FIGS. 1 and 2 illustrate a first embodiment of the invention. The toothbrush 2 comprises a handle 4 which is elongate in a rectilinear general direction. The handle has a terminal end 6 provided with bristles 9 for brushing, thus forming the head of the brush. The head 6 has one face 8 from which the bristles 9 extend, the face being flat in the vicinity of the bristles, and the bristles extending at right angles from the face 8. The head has another face 10, on the opposite side from the face 8, whose shape is profiled along the longitudinal direction of the brush, the profile having a generally semicircular form and thus generating two edges 12 at the intersection with the face 8. For convenience and with reference to FIG. 1, faces 8 and 10 will be referred to as the upper and lower faces, respectively.

Moving toward the other terminal end 20 of the brush, the lower face 8 moves away from the curved upper face 10 so that the thickness of the brush (measured parallel to the bristles 9) increases. For this purpose, the lower face 8 is continued by a section whose profile is curved parallel to the longitudinal direction of the brush. The lower face 8 eventually stops when the two edges 12 meet before reaching mid-way along the length of the brush. This is followed by a portion 14 of the brush, where the profile of the handle is thus approximately circular.

The section 14 supports a ring or central or proximal portion 16 described later, situated approximately mid-way between the two terminal ends of the brush, but closer to the head 6 than to the other end 20. The circular section 14 continues on the other side of the ring 16.

The brush has a lower flat 18 on the same side of the handle as the lower face 8 supporting the bristles. This flat 18 is generally parallel to the longitudinal direction of the brush, though very slightly raised toward the rear end 20 so that the thickness of the handle diminishes toward this end. On the opposite side from the lower flat 18, the handle has an upper face 22 of curved profile similar to the upper face 10, which continues the circular section 14 as far as the end 20. The intersection of this upper face 22 with the lower flat 18 generates an edge 24 in the form of a very elongate ellipse, the major axis of the ellipse being approximately parallel to the longitudinal direction of the brush.

The ring 16 is fixed relative to the handle. In the present case, it is shaped like an oval or very flattened ovoid disk. The general plane of the ring 16 is inclined in this case relative to the direction perpendicular to the length of the brush. In the present case, the ring 16 projects from the section 14, that is to say from the handle 4, all the way around the handle, so producing the impression that the handle is passing through an imaginary orifice inside the ring. The ring 16 is also in this case eccentric with respect to the longitudinal axis of the handle so that the ring projects from the handle to a greater distance above the upper faces 10 and 22 than below the lower face 8 and lower flat 18. This distance is at its least below the lower face 8, is greater on the sides of the brush and at its greatest above the upper faces 10 and 22. Because the ring is tilted, it follows that the ring projects for a short distance on the bristle side, toward the bristles, whereas it projects for a long distance on the upper or non-bristle side, away from the bristles. With the handle, the ring 16 forms two re-entrant edges of circular general form 24, 26, toward the front and rear, respectively, of the brush.

The handle and the ring may be made, for example, from a hard, lightweight plastic material, the ring also being for example covered with a softer elastomer designed to form the outer face of the ring 16.

The width of the brush at right angles to its thickness decreases from the ring 16 to each of its terminal ends, to give it a tapering form as illustrated in FIG. 2.

The mass distribution of the brush and its volume are selected to ensure that, on any flat horizontal support 30, the brush has a position of stable equilibrium in which the brush rests on the support via a point 32 situated at the rear end 20 on the flat 18, and via a point 34 situated on the perimeter of the ring 16, on the same side as the bristles 9. In this position, the bristles 9 extend toward the support 9, at right angles to the plane of the support and at a distance from it, the free lower extremities of the bristles being off the support.

In addition, the mass distribution and the volume are such that this position constitutes the only position of stable equilibrium of the brush on a flat horizontal support. This means that, when the user places the brush on the support in any position in which the brush is laid more or less parallel to the support, the brush rolls spontaneously under the action of gravity in order to position itself in the abovementioned stable position. The rolling occurs partly at the end 20, on the upper face 22 and the flat 18. It also occurs around the perimeter of the ring 16 which, due to the convex circular form of this perimeter, always has only one point of contact with the support. By extension, the user can even place the brush in any position on the support, for example, standing it on the rear end 20, and the brush will always fall down horizontal, before rolling into its stable position. (The only risk is then that as it falls, the bristles may contact the support.) Here the stable position will be reached after a few oscillations of the brush about its stable position until it becomes motionless because, in the stable position, the brush rests on the support via two points only. The eccentric ring 16 here plays a significant part in this function of the brush, as do the volume and the mass distribution of the brush as a whole.

The rolling of the brush from any position into the stable position takes place without any contact between the bristles and the support, and thus improving the hygiene of the brush. The elastomer covering the ring ensures that the brush rolls quietly, even if the support is made of a hard material.

During brushing, the user can hold the brush in the hand by means of the handle section extending between the stop 16 and the rear end 20. The ring 16 can thus be used as a stop for at least one of the fingers of the hand, for example the thumb and/or the index finger, so as to enable the brush to be held firmly or facilitate its rotation in the hand during brushing. Additionally, the stop 16 limits or even prevents liquid from running down from the bristles to the rear end 20 and to the user's hand. The handle thus remains clean and dry.

During the rolling of the brush on the support, the part 17 of the section 14 of the handle contiguous with the ring 16 on the opposite side from the bristles never comes into contact with the support.

That part of the section 14 of the handle which is next to the bristle-facing side of the ring may have a smaller diameter than the diameter of the other part 17 of the section 14 on the side facing away from the bristles so that it can take a cap fitting over the bristles as far as the ring, the outline of which will be a continuation of the part 17.

Figure 3:
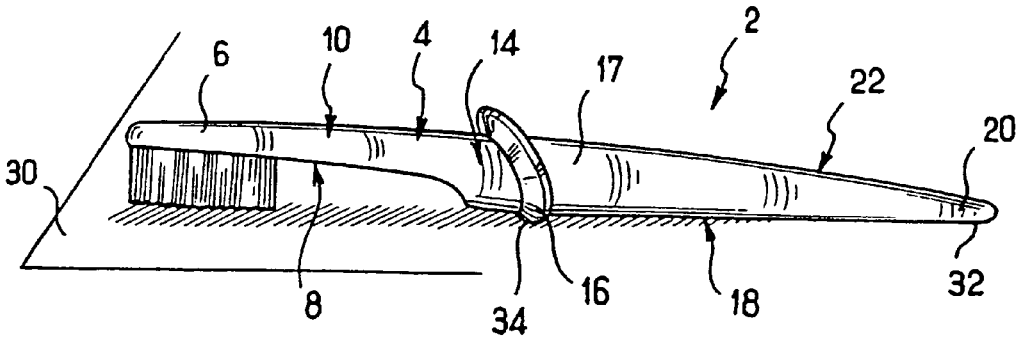
FIGS. 3–5 are views similar to FIG. 1 showing three other respective embodiments.

Illustrated in FIG. 3 is a second preferred embodiment very similar to the previous embodiment. This embodiment is distinguished from the previous one primarily by the tilt of the ring 16 which is the opposite of what it is in the first embodiment, such that the upper part of the ring—that projecting the furthest from the handle—extends on this occasion toward the head. The other features of the brush are essentially unchanged. Operation of the brush is the same, and remains characterized by a single stable position.

Figure 4:
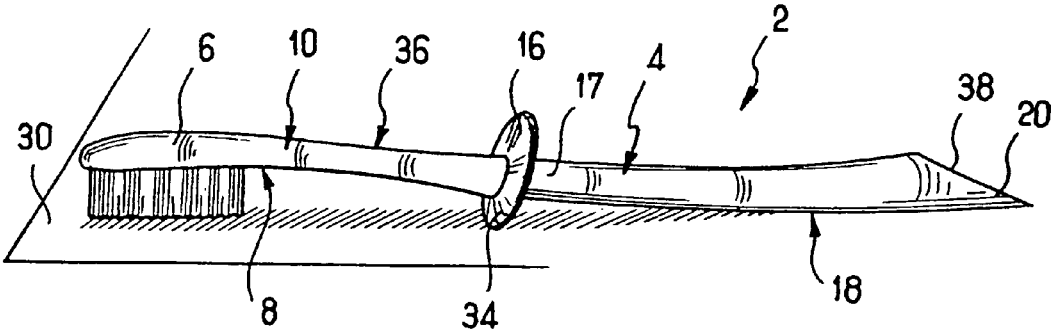

FIG. 4 illustrates a third embodiment. On this occasion, the tilt of the ring 16 is close to that of the first embodiment although less pronounced. The head 6 is largely unchanged compared with the first embodiment. However, the cross section of the handle decreases, beginning at the base of the head 6, and is at a minimum roughly at a point 36 situated mid-way between the head 6 and the ring 16. Beginning at this section, and moving toward the rear end 20, the handle has an elongate and very slightly curved shape (its center of curvature being situated on the far side from the bristles), the cross section of the handle increasing toward the rear end 20. The lower flat 18 is always present although its width is less than in the first embodiment. Also, on the upper side of the end 20 is a bevel 38 of elliptical shape in plan view and with a slight convex curvature in longitudinal profile.

There is no change to the operation of the brush. In the stable position, the ring 16 has a single point of contact with the support and the flat 18 here forms a surface-to-surface contact with the support with a number of points of contact greater than or equal to three. As a result, the oscillations of the brush about the position of equilibrium are reduced or absent. Beginning in any position, the rolling of the brush takes place partly on the ring 16 and partly on the lower flat 18 and the upper half of the elliptical edge of the bevel 38 situated at the opposite end of the handle from the bristles.

Figure 5:
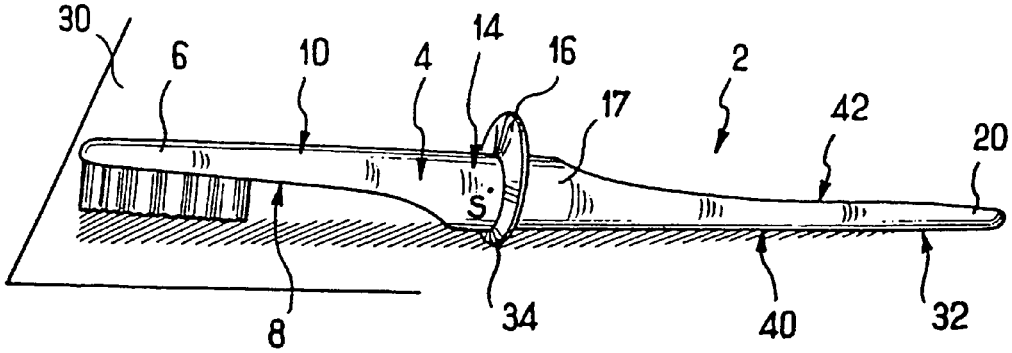

FIG. 5 illustrates a fourth embodiment of the invention. On this occasion, the ring 16, which is off-center again, extends in a general plane at right angles to the longitudinal direction of the brush. The part of the brush extending from the head 6 inclusive, to the ring 16, is practically identical to that in FIG. 1. The part of the handle extending from the ring 16 to the rear end 20 is more or less symmetrical to the above part about a point of symmetry S situated on the longitudinal axis of the brush, in the interior of the brush level with the ring 16. In this way, the handle part has a circular lower face 40 and a flat upper face 42 that is curved as it approaches the ring 16. Once again, the brush has a single position of stable equilibrium. On this occasion, in the stable position, the brush rests on the support via a point 34 of the ring and a point 32 of the curved lower face 40, close to the rear end 20.

It is, of course, possible to make numerous modifications to the invention without departing from its scope.

For example, the brush may be designed so that it has at least two positions of stable equilibrium, in each of which the brush extends parallel to the support with the bristles pointing toward the support, possibly being inclined with respect to the support, and at a distance from it.

It will be appreciated that the options as to the volume and mass distribution of the brush according to the invention are numberless. In particular, the differences of shapes between two brushes in accordance with the invention can be very pronounced or on the contrary minor, not to say imperceptible.

As has been seen, the ring 16 is a very simple way of producing the function of the brush according to the invention. Nonetheless, this function is not dependent solely on the configuration of the ring and on its position on the brush, but also depends very much on the configuration of the brush as a whole. Consequently, it is possible to position the ring centrally on the handle, provided that the configuration of the rest of the handle produces the abovementioned function. Another possibility is to dispense with the ring and choose a volume and mass distribution of the brush which in themselves produce the abovementioned function. Material may be added on each side of the ring 16 to make the surface of the handle continuous with the perimeter of the ring and thus no longer distinguish the ring and so obliterate the edges 24, 26.

It is also possible to provide, independently of the invention, a toothbrush of elongate form, comprising bristles, and so designed as to exhibit on a flat horizontal support a single position of stable equilibrium in which position the longitudinal direction of the brush is essentially parallel to the support and the bristles lie at a distance from the support.

What is claimed is:

1. A toothbrush of elongate form, comprising, bristles;

a distal portion;

a proximal portion of a generally flat shape in a plane that is essentially inclined with respect to the longitudinal direction of the brush, and which proximal portion extends between the bristles and the distal portion in the longitudinal direction; and an intermediate portion between the distal and proximal portions, wherein the toothbrush has, on a flat horizontal support, at least one position of stable equilibrium;

in any position of stable equilibrium of the toothbrush on the support, the longitudinal direction of the toothbrush is essentially parallel to the support and the bristles lie at a distance from the support and extend toward the support; and for any position in which the toothbrush is supported by a flat horizontal support with the longitudinal direction essentially parallel to the support, the distal and proximal portions constitute the portions of contact of the toothbrush with the flat support and the intermediate portion lying at a distance from the support.

2. The toothbrush as claimed in claim 1, wherein there is only one position of stable equilibrium of the brush.

3. The toothbrush as claimed in claim 1, wherein the proximal portion exhibits a single point of contact with the support in one or more positions of stable equilibrium.

4. The toothbrush as claimed in claim 1, wherein, for any position in which the brush is supported by a flat horizontal support with the longitudinal direction essentially parallel to the support, the proximal portion exhibits a single point of contact with the support.

5. The toothbrush as claimed in claim 1, wherein the proximal portion has an elastomeric outer face.

6. The toothbrush as claimed in claim 1, wherein the distal portion exhibits two points of contact with the support in one or more positions of stable equilibrium.

7. The toothbrush as claimed in claim 1, wherein the distal portion has a flat part generally parallel to the longitudinal direction of the brush.

8. A toothbrush of elongate form, comprising, bristles;

a distal portion:

a proximal portion which is off-center with respect to a central longitudinal axis of the brush, and which proximal portion extends between the bristles and the distal portion in the longitudinal direction; and an intermediate portion between the distal and proximal portions, wherein the toothbrush has, on a flat horizontal support, at least one position of stable equilibrium;

in any position of stable equilibrium of the toothbrush on the support, the longitudinal direction of the toothbrush is essentially parallel to the support and the bristles lie at a distance from the support and extend toward the support; and for any position in which the toothbrush is supported by a flat horizontal support with the longitudinal direction essentially parallel to the support, the distal and proximal portions constitute the portions of contact of the toothbrush with the flat support and the intermediate portion lying at a distance from the support.

9. The toothbrush as claimed in claim 8, wherein there is only one position of stable equilibrium of the brush.

10. The toothbrush as claimed in claim 8, wherein the proximal portion exhibits a single point of contact with the support in one or more positions of stable equilibrium.

11. The toothbrush as claimed in claim 8, wherein, for any position in which the brush is supported by a flat horizontal support with the longitudinal direction essentially parallel to the support, the proximal portion exhibits a single point of contact with the support.

12. The toothbrush as claimed in claim 8, wherein the proximal portion has an elastomeric outer face.

13. The toothbrush as claimed in claim 8, wherein the distal portion exhibits two points of contact with the support in one or more positions of stable equilibrium.

14. The toothbrush as claimed in claim 8, wherein the distal portion has a flat part generally parallel to the longitudinal direction of the brush.

* * * * *